US005110117A

United States Patent [19]

Fisher et al.

[11] Patent Number: 5,110,117

[45] Date of Patent: May 5, 1992

[54] TREADMILL WITH PIVOTING HANDLES

[75] Inventors: Milton W. Fisher, Lexington, Mo.; Glen E. Henson, 8793 Blue Ridge Blvd., Kansas City, Mo. 64138

[73] Assignee: Glen Henson, Kansas City, Mo.

[21] Appl. No.: 485,620

[22] Filed: Feb. 27, 1990

[51] Int. Cl.[5] ..... A63B 23/66

[52] U.S. Cl. ..... 482/54; 482/72; 482/128; 482/130

[58] Field of Search ..... 272/70, 69, 72, 136, 272/97, 142, 141, 134

[56] References Cited

U.S. PATENT DOCUMENTS

| | | | |
|---|---|---|---|
| 3,345,067 | 10/1967 | Smith | 272/134 |
| 3,638,941 | 2/1972 | Kulkens | 272/142 |
| 3,659,845 | 5/1972 | Quinton | 272/69 |
| 4,204,673 | 5/1980 | Speer | 272/69 |
| 4,434,981 | 3/1984 | Norton | 272/97 |
| 4,621,623 | 11/1986 | Wang | 272/72 |
| 4,832,332 | 5/1989 | Dumbser | 272/69 |

OTHER PUBLICATIONS

"NordicTrack" Advertising.

*Primary Examiner*—Richard J. Apley
*Assistant Examiner*—J. Donnelly
*Attorney, Agent, or Firm*—Shook, Hardy & Bacon

[57] ABSTRACT

A treadmill equipped with a pair of spring loaded handles that allow the user to exercise the arms and shoulders while walking on the treadmill surface. The handles can be mounted in different rotative positions on stub shafts so that they can be oriented to meet the desires of the user. Pivotal movement of the handles is resisted by compression springs mounted on rods which slide axially when the handles are pivoted back and forth.

13 Claims, 2 Drawing Sheets

TREADMILL WITH PIVOTING HANDLES

BACKGROUND AND SUMMARY OF THE INVENTION

This invention relates generally to the field of exercise equipment and more particularly to a treadmill that is provided with pivoting handles for exercising the arms and shoulders at the same time the treadmill is used as a walking surface.

It is the principal object of the invention to provide an exercise treadmill having a pair of pivoting bars that are equipped with handles to permit the user of the treadmill to walk normally on the treadmill surface and simultaneously reciprocate the pivoting bars in order to exercise the upper body.

Another object of the invention is to provide, in a treadmill of the character described, a spring resistance system which resists pivoting of the bars in order to enhance the exercise effect.

A further object of the invention is to provide, in a treadmill of the character described, a simple and effective way to adjust the resistance force of the spring resistance system.

An additional object of the invention is to provide a treadmill in which the pivoting bars can be adjusted to different positions so that the handles can be located and oriented in accordance with the needs and desires of different users.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
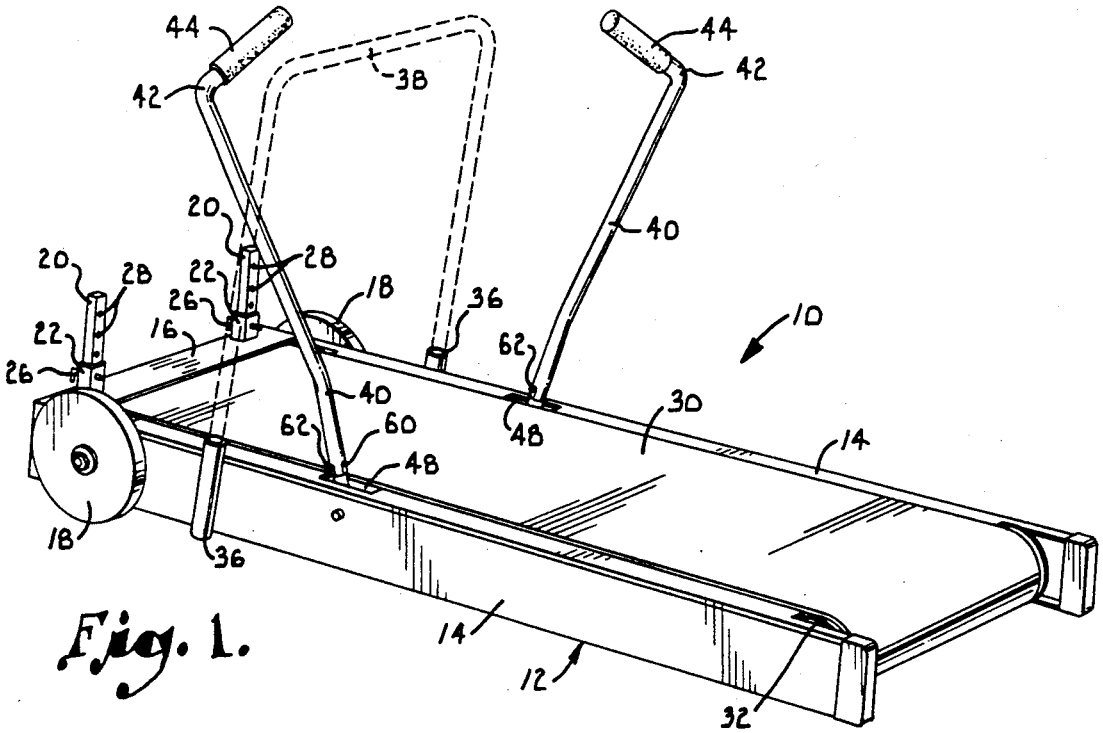
FIG. 1 is a perspective view of a treadmill constructed according to a preferred embodiment of the present invention, with the pivotal bars oriented such that the handles project inwardly and with an optional handlebar shown in broken lines.

Referring now to the drawings in more detail, numeral 10 generally designates an exercise treadmill constructed in accordance with the present invention. The treadmill 10 has a rigid frame 12 which includes opposite sides that take the form of rigid channels 14. The channels 14 are parallel to one another and are connected at their forward ends by a front piece 16. Each channel 14 is equipped with a large wheel 18 which facilitates moving the treadmill between different locations. A pair of square posts 20 extend through complemental sleeves 22 mounted on the front piece 16, and each post 20 is provided on its lower end with a small wheel 24. (See FIG. 2). L-shaped pins 26 fit through the sleeves 22 and through selected holes 26 formed in posts 20 in order to permit the angle of inclination of the treadmill to be adjusted.

The treadmill 10 has a treadmill surface formed by an endless belt 30 which is drawn around flanged drums 32 (only one of which is visible in FIG. 1). The drums 32 are supported for rotation in extension between the front and back ends of the channels 14. Smaller idler rollers 24 (see FIGS. 3 and 4) extend between the channels 16 along substantially their entire lengths to receive and support the upper run of the belt 30. The upper run of the belt 30 is thereby located in a plane lying immediately above the top flanges of the channels 16, and it is able to move rearwardly when a user of the treadmill stands on the belt and strides in a forward direction.

The channels 14 are each provided with a sleeve 36. A u-shaped handlebar 38 can be inserted in the sleeves 36 to locate the horizontal crossbar of the handlebar 38 at a location where it can be grasped by a user standing on the belt 30. The handlebar 38 is optional and may be removed from the sleeves 36 when it is not in use.

In accordance with the present invention, the treadmill 10 is equipped with a pair of pivoting bars 40 which are pivotally connected with the respective channels 16 at their lower ends and which are provided at their upper ends with short handles 42. The handles 42 meet the bars 40 at an approximate right angle, although the angularity can vary. Each handle 42 is equipped with a handgrip 44 which is sleeved over the handle and which is constructed of a material that provides a comfortable and secure grip. Each bar 40 is preferably constructed of a hollow cylindrical tube, and a lower portion of each bar is bent at a slight angle.

Each bar 40 is detachably mounted on a corresponding stub 46 which is pivotally mounted on the frame 12. The stubs 46 project upwardly through slots 48 which are formed through the upper flanges of the channels 16 somewhat forwardly of the center of the treadmill.

Figure 3:
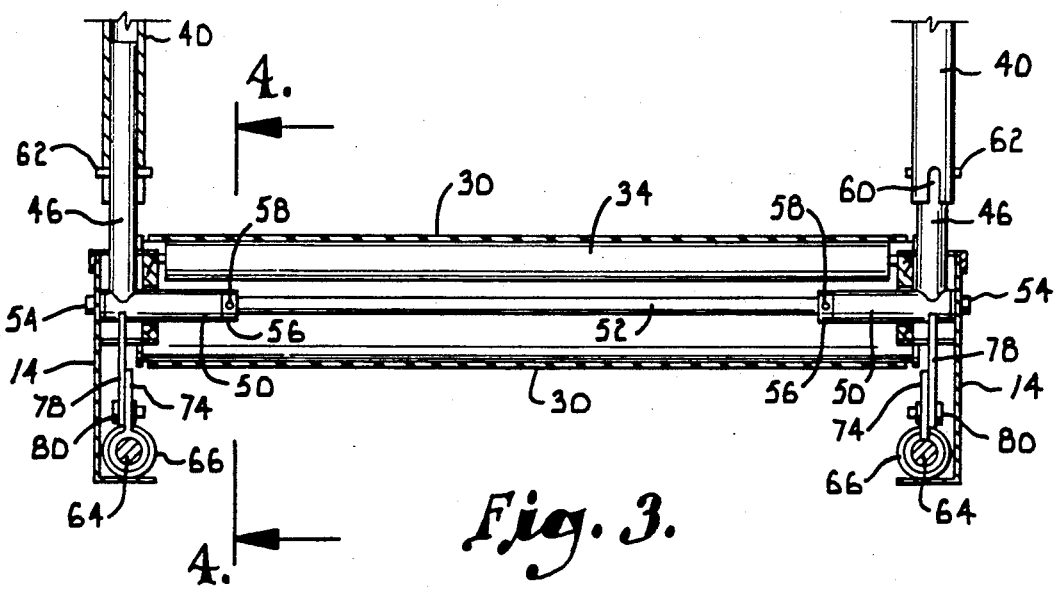
FIG. 3 is a fragmentary sectional view on an enlarged scale taken generally along line 3—3 of FIG. 2 in the direction of the arrows.

As best shown in FIG. 3, each stub 46 projects upwardly from a sleeve 50, and the sleeves 50 are mounted to turn on a transverse rod 52 which extends between the opposite channels 16. The rod 52 is secured to the channels 16 by suitable fasteners 54. Axial movement of the sleeves 50 on rod 52 is prevented by collars 56 which are fixed on the rod 52 by set screws 58.

The bars 40 are open at their lower ends and are each equipped with four slots 60 which extend into the lower edge of each tube. The slots 60 are spaced uniformly apart on each tube at 90° angular increments. Each stub 46 is provided with a horizontal pin which extends through the stub and projects outwardly at diametrically opposed locations. The lower ends of the bars 40 can be fitted closely on the stubs 46 with two diametrically opposed slots 60 fitting on the projecting pins 62. This mounts the bars 40 on the frame of the machine for pivotal movement with the stubs about the horizontal pivot axis defined by the transverse rod 52.

Figure 2:
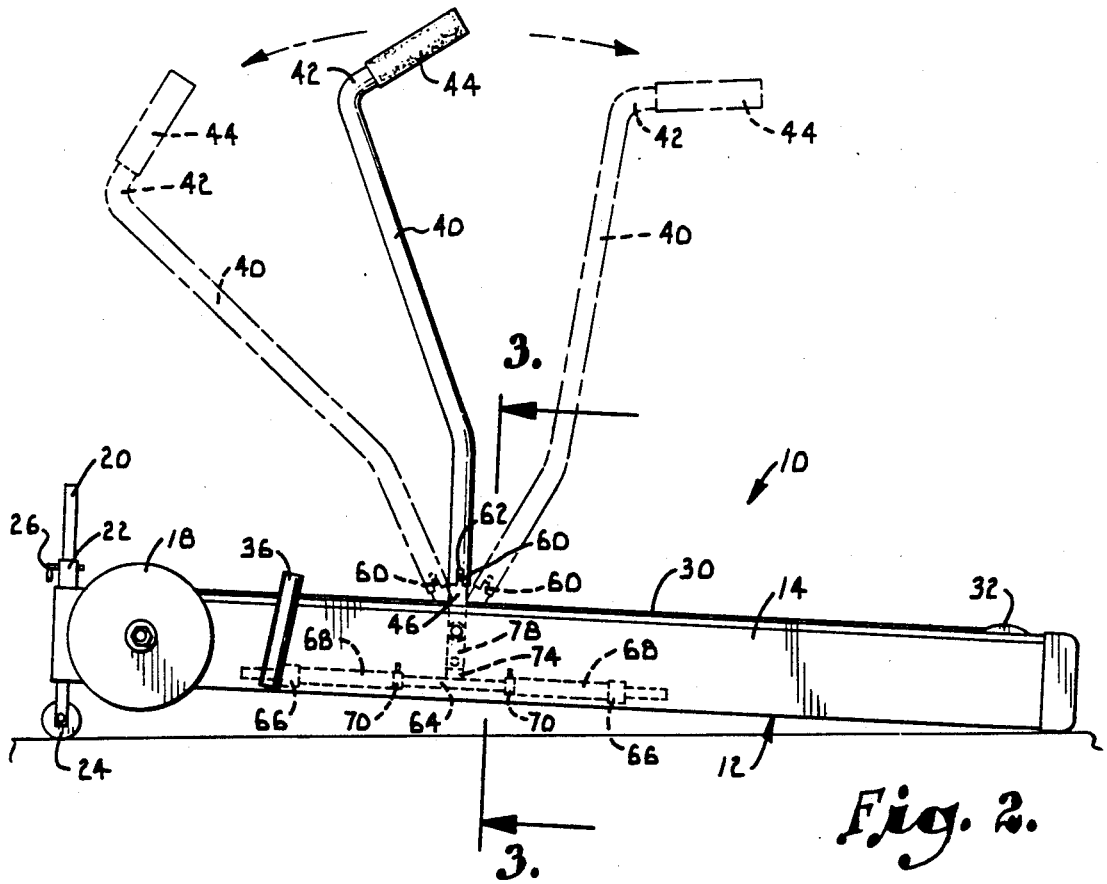
FIG. 2 is a side elevational view of the treadmill, but with the pivotal bars oriented such that the handles project rearwardly and with the bars shown pivoted forwardly and rearwardly in broken lines.

It is a particular feature of the invention that this manner of mounting the bars 40 permits the bars to be located in four different rotative positions, depending upon which of the slots 60 are aligned with the pins 62. In one rotative position, the handles 42 are oriented to project inwardly as shown in FIG. 1. Each bar 40 can be removed and rotated 180° from the position of FIG. 1 and installed with the handle 42 projecting outwardly. Additionally, each bar 40 can be installed with the handle 42 projecting either rearwardly (as shown in FIG. 2) or forwardly. In this manner, the handles 42 can be oriented at any of four different positions, depending upon the needs and desires of the user of the machine. The bars 40 are long enough to locate the handles 42 at the proper height to be conveniently gripped by a user of the machine. When the machine is not in use, the bars 40 can be removed so that the machine can be stored in a compact manner.

Pivotal movement of the bars 40 is resisted by a spring resistance system. The spring resistance system for each bar 40 is identical, and only one resistance system will be described.

Figure 4:
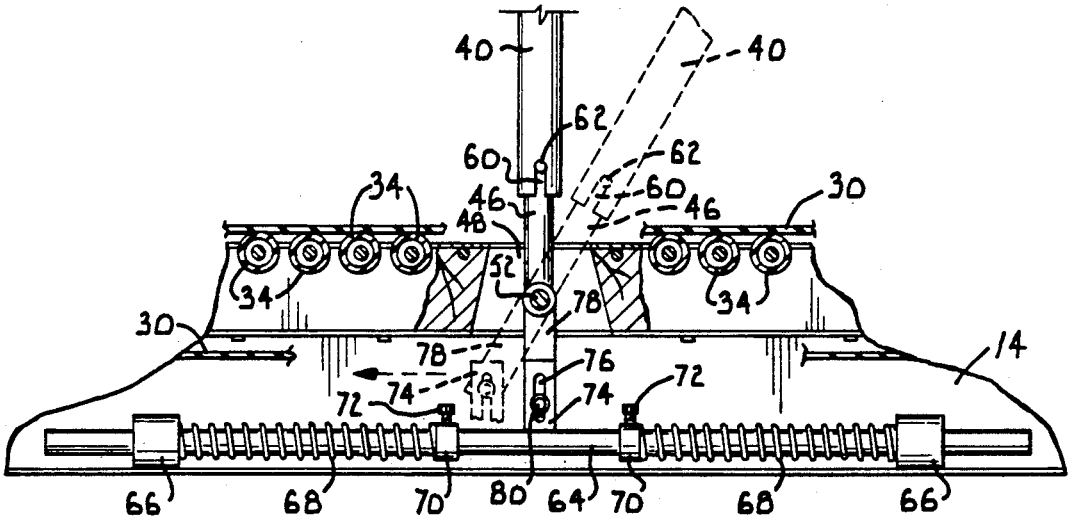
FIG. 4 is a fragmentary sectional view taken generally along line 4—4 of FIG. 3 in the direction of the arrows.

With particular reference to FIGS. 3 and 4, a rod 64 is mounted to each channel 16 for sliding movement longitudinally of the treadmill 10 or in a direction perpendicular to the transverse rod 52. Each rod 64 extends slidably through a pair of spaced apart bushings 66 which are mounted on the lower flange of the channel 16. A pair of compression springs 66 are coiled around each slidable rod 64, with one end of each spring 68 bearing against one of the bushings 66. The opposite ends of the springs 68 bear against adjustable collars 70 which are fitted on rod 64 and may be secured to the rod by set screws 72.

The springs 68 apply forces to the rod 64 which continuously urge the rod toward the neutral position shown in solid lines in FIG. 4. When the rod is slid axially away from the neutral position in either direction, one of the springs 68 is deformed in compression and thus tends to return the rod to the neutral position at which the forces of the two springs are balanced. Each collar 70 can be adjusted by loosening the set screw 72 and sliding the collar in one direction or another along the length of rod 64 before tightening the set screw again. In this manner, the compression of each spring 68 can be adjusted in order to increase or decrease the spring force that is exerted by the spring in resistance to axial movement of the rod 64.

Each rod 64 is provided with a tab 74 which projects upwardly from the center of the rod and which has a vertical slot 76. A lever 78 projects downwardly from each sleeve 5 and fits against the corresponding tab 74. A fastener 80 is connected with each lever 78 and extends through the corresponding slot 76 in order to establish a connection between each lever 78 and the corresponding tab 74. The connection is both a pivotal and a sliding connection which permits the lever 78 to pivot about the axis of the fastener 80 and also allows the fastener 80 to slide up and down along the length of the slot 76. Consequently, when the bars 40 are pivoted back and forth, the connection between the levers and tabs accommodates axial sliding movement of the rod 64.

In use of the treadmill, the user stands on the belt 30 at a location slightly behind the bars 40 and strides to cause the upper run of the belt 30 to move from front to back. At the same time, the user grasps the handgrips 44 and reciprocates the bars 40 about the axis of the transverse rod 52. Normally, the bars 40 are pivoted such that they are out of phase with one bar 40 being pivoted forwardly while the other bar is pivoted rearwardly.

The springs 68 normally maintain the bars 40 in the vertical neutral position shown in solid lines in FIGS. 2 and 4. However, when either bar is pivoted from the neutral position, one of the springs 68 is compressed and resists the pivotal movement of the bar, thus enhancing the exercise effect because the spring force must be overcome to pivot the bars.

Figure 5:
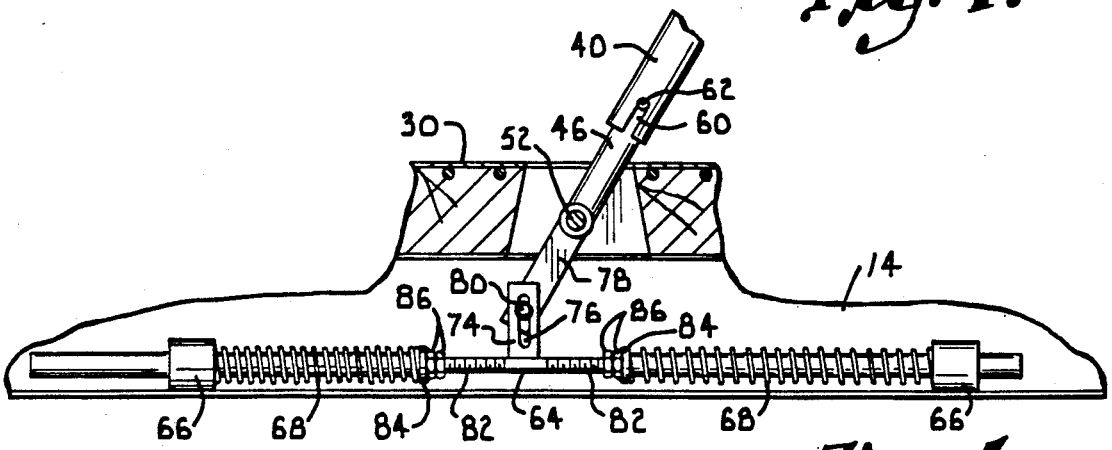
FIG. 5 is a fragmentary sectional view similar to FIG. 4, but showing an alternative spring retaining and adjustment system.

FIG. 5 depicts an alternate arrangement for adjusting the spring force. The arrangement of FIG. 5 differs from the FIG. 4 arrangement in that the central portion of the rod 64 is reduced in diameter and threaded at 82 on opposite sides of the tab 74. The adjustable collars 70 are eliminated and replaced by washers 84 which are fitted on the rod 64 with the springs bearing against them. Each threaded portion 82 receives a pair of nuts 86 which can be threaded inwardly or outwardly in order to adjust the tension of the springs 68. As shown in FIG. 3, the channels 16 are open from the inside beneath the lower run of the belt 30. Consequently, the treadmill can be raised to provide access to the spring adjustment mechanism in both embodiments of the invention.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A treadmill comprising:
a rigid frame having opposite sides;
a treadmill surface on the frame providing a movable walking surface for a user of the treadmill;
a pair of elongated bars;
means for mounting said bars on the opposite sides of the frame in generally upright positions and in a manner allowing each bar to be reciprocated pivotally about a generally horizontal pivot axis;
a rod mounted on each side of the frame for axial sliding movement and coupled with the bar on said side in a manner to slide in opposite axial directions when the bar is pivoted from the neutral position in opposite pivotal directions;
a pair of springs on said rod each arranged to be deformed when the rod is moved axially in opposite directions, said springs resisting deformation to urge said rod to slide in a direction to return the bar to the neutral position thereof; and
a handle on each bar located to be grasped by a user standing on said treadmill surface to permit the user to reciprocate each bar in opposite directions about the pivot axis thereof.

2. The treadmill of claim 1, including means for adjusting the force exerted by each spring to resist axial sliding of the rod.

3. The treadmill of claim 1, including means for establishing a sliding connection between each bar and the corresponding rod at a location offset from the pivot axis of the bar.

4. The treadmill of claim 1, wherein:
said handles project angularly from the bars; and said mounting means is arranged to mount the bars in different rotative orientations in which the handles project in different directions from the bars.

5. The treadmill of claim 1, wherein said mounting means includes:

a transverse rod extending between said opposite sides of the frame; and a sleeve coupled with each bar, said sleeves being fitted rotatively on said rod on the opposite sides of the frame.

6. The treadmill of claim 1, wherein:

said handles project angularly from the bars; and said mounting means is arranged to mount the bars in different rotative orientations in which the handles project in different direction from the bars.

7. A treadmill comprising:

a rigid frame having opposite sides;

a treadmill surface on the frame providing a movable walking surface for a user of the treadmill;

a pair of elongate bars;

a traverse rod extending between said opposite sides of the frame;

a sleeve coupled with each bar, said sleeves being fitted rotatively on said rod on the opposite sides of the frame;

a lever projecting from each sleeve;

a slidable rod on each side of the frame supported thereon for axial sliding movement in a direction substantially perpendicular to the axis other transverse rod;

means for establishing a pivotal and slidable connection between each lever and the corresponding slidable rod to effect axial sliding of the slidable rods in opposite directions when the bars are pivoted in opposite directions;

a spring means for applying a resistance force opposing sliding movement of the slidable rods in both directions; and a handle on each bar located to be grasped by a user standing on said treadmill surface to permit the user to reciprocate each bar in opposite directions about the pivot axis thereof.

8. The treadmill of claim 7, including means for adjusting the resistance force applied by said spring means.

9. A treadmill comprising:

a rigid frame having opposite sides;

a treadmill surface on the frame providing a movable walking surface for a user of the treadmill;

a pair of elongate bars;

a stub for each bar mounted in the frame for pivotal movement about the pivot axis of the bar;

means for establishing the connection between each bar and the corresponding stub with each connection allowing the bar to assume a plurality of different rotative positions about the axis of the stub;

means for detachably securing each bar on the corresponding stub in each of said rotative positions; and a handle on each bar located to be grasped by a user to reciprocate each bar in opposite directions about the pivot axis thereof.

10. The treadmill of claim 9, including means of resisting pivotal movement of each bar about the pivot axis thereof.

11. In an exercise treadmill having a frame with opposite sides and a movable treadmill surface, the improvement comprising:

a pair of bars each having top and bottom ends;

a handle on the top end of each bar extending from the bar at an angle;

a stub for each bar mounted on the frame for pivotal movement about the pivot axis of the bar;

means for establishing a connection between each bar and the corresponding stub with each connection allowing the bar to assume a plurality of different rotative positions about the axis of the stub; and means for detachably securing each bar on the corresponding stub in each of said rotative positions.

12. In an exercise treadmill having a frame with opposite sides and a movable treadmill surface, the improvement comprising:

a pair of bars each having top and bottom ends, said bars each having a handle on the top end thereof;

means for mounting said bars on the opposite sides of the frame for pivotal movement about a generally horizontal pivot axis with the handles located at a height to be grasped by a user standing on the treadmill surface to permit the user to reciprocate each bar in opposite directions about the pivot axis thereof;

a rod on each side of the frame supported thereon for axial sliding movement in a direction substantially perpendicular to said pivot axis;

means for coupling each bar with a corresponding rod in a manner to effect axial sliding movement of the rod in opposite directions when the bar is pivoted away from the neutral position in opposite directions; and a pair of springs acting on each rod in a manner to resist axial sliding of the rod in both directions.

13. The improvement of claim 11, including means for resisting pivotal movement of each bar about the pivot axis thereof.

* * * * *

UNITED STATES PATENT AND TRADEMARK OFFICE

CERTIFICATE OF CORRECTION

PATENT NO. : 5,110,117

DATED : May 5, 1992

INVENTOR(S) : Fisher et al.

It is certified that error appears in the above-identified patent and that said Letters Patent is hereby corrected as shown below:

Claim 7, column 5, line 29, "other" should be "of the".

Signed and Sealed this

Seventh Day of September, 1993

Bruce Lehman

*Attest:*

BRUCE LEHMAN

*Attesting Officer*

*Commissioner of Patents and Trademarks*